US009528683B2

(12) United States Patent
Radl et al.

(10) Patent No.: US 9,528,683 B2
(45) Date of Patent: Dec. 27, 2016

(54) SHAPED INDIRECT LUMINAIRE

(71) Applicants: Bruce Radl, Stow, MA (US); Alice Chang, South Hamilton, MA (US); Amina Chidiac, Portsmouth, NH (US)

(72) Inventors: Bruce Radl, Stow, MA (US); Alice Chang, South Hamilton, MA (US); Amina Chidiac, Portsmouth, NH (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days.

(21) Appl. No.: 14/703,594

(22) Filed: May 4, 2015

(65) Prior Publication Data

US 2015/0233543 A1 Aug. 20, 2015

Related U.S. Application Data

(63) Continuation-in-part of application No. 13/629,787, filed on Sep. 28, 2012, now Pat. No. 9,022,606.

(51) Int. Cl.
*F21S 8/02* (2006.01)
*F21V 7/06* (2006.01)
(Continued)

(52) U.S. Cl.
CPC ..... *F21V 7/06* (2013.01); *F21V 13/08* (2013.01); *F21V 19/002* (2013.01); *F21V 23/023* (2013.01); *F21Y 2101/02* (2013.01)

(58) Field of Classification Search
CPC ..... F21V 7/0008; F21V 7/0025; F21V 7/005; F21V 7/0066; F21V 7/04; F21V 7/09; F21V 15/01; F21V 7/00; F21V 7/06; F21V 13/04; F21V 1/12; F21V 5/02; F21V 7/0041; F21Y 2101/02; F21Y 2103/00; F21Y 2103/003; F21Y 2113/005;F21S 8/02; F21S 8/04; F21S 8/00; F21S 8/022; F21S 8/024; F21S 8/026; F21S 8/03; F21S 48/1388
(Continued)

(56) References Cited

U.S. PATENT DOCUMENTS 3,560,729 A * 2/1971 Liberman ..... 362/294
5,051,878 A 9/1991 Ngai
(Continued)

FOREIGN PATENT DOCUMENTS

DE 10 2010 001777 A1 8/2011
WO WO 2008146229 A2 * 12/2008
WO 2010029475 A1 3/2010

OTHER PUBLICATIONS

Andreas Schulz, International Search Report and Written Opinion of the International Searching Authority for PCT/US2013/060418, pp. 1-11, Nov. 29, 2013, European Patent Office, Rijswijk, The Netherlands.

*Primary Examiner* — Hargobind S Sawhney
(74) *Attorney, Agent, or Firm* — Shaun P. Montana

(57) ABSTRACT

A luminaire is provided, that includes a housing and a plurality of solid state light sources connected thereto. The housing has a top side, two lateral sides, a protrusion in the top side, and two light source mounting surfaces. The top side is diffusely reflecting and has opposing lateral edges and a center. The lateral sides are specularly reflecting and extend generally downward from the opposing lateral edges of the top side. Each has a respective bottom edge. The light source mounting surfaces extend laterally inward from the respective bottom edges. The plurality of solid state light sources is disposed along the pair of light source mounting surfaces proximate the pair of specularly reflecting lateral sides. These emit light, which travels upward to the top side and is also specularly reflected by the lateral sides toward the
(Continued)

100 top side. The top side diffusely reflects the light out of the luminaire.

17 Claims, 20 Drawing Sheets

(51) Int. Cl.
*F21V 13/08* (2006.01)
*F21V 23/02* (2006.01)
*F21V 19/00* (2006.01)
*F21Y 101/02* (2006.01)

(58) Field of Classification Search
USPC ..... 362/140, 145–148, 217.01, 217.05, 362/217.07–217.09, 217.1, 362/217.14–217.16, 225, 240–247, 362/249.01, 249.02, 249.11, 260, 362/296.01, 297, 299, 301–303, 310, 362/326–330, 341, 346–348, 355, 364, 362/800
See application file for complete search history.

(56) References Cited

U.S. PATENT DOCUMENTS

| | | | | |
|---|---|---|---|---|
| 6,561,678 | B2 * | 5/2003 | Loughrey | 362/282 |
| 7,980,723 | B2 * | 7/2011 | Kosters | 362/217.07 |
| 8,425,101 | B2 * | 4/2013 | Boonekamp | 362/609 |
| 8,523,389 | B2 * | 9/2013 | Holten et al. | 362/246 |
| 8,534,880 | B1 * | 9/2013 | Berg | F21V 29/505 362/218 |
| 2007/0211457 | A1 * | 9/2007 | Mayfield et al. | 362/223 |
| 2011/0002682 | A1 * | 1/2011 | Messina | 396/200 |
| 2012/0051041 | A1 | 3/2012 | Edmond et al. | |

* cited by examiner

100f

SHAPED INDIRECT LUMINAIRE

CROSS-REFERENCE TO RELATED APPLICATION

The present application is a continuation-in-part of, and claims priority to, U.S. patent application Ser. No. 13/629,787, filed Sep. 28, 2012 and entitled "VIRTUAL SURFACE INDIRECT RADIATING LUMINAIRE", now U.S. Pat. No. 9,022,606, the entire contents of which are hereby incorporated by reference.

TECHNICAL FIELD

The present invention relates to lighting, and more specifically, to a luminaire for lighting.

BACKGROUND

Conventional downward-facing luminaires are well known, frequently stylish though sometimes merely boringly functional, and produce light to which people work, play, live, and want. For office lighting, a common type of luminaire is known as a "troffer", in which light from an elongated fluorescent bulb is directed upward toward an inverted trough having a diffuse reflecting surface. The diffusely reflected light from the inverted trough is directed downward, toward a work surface in the office. These troffers are often sold as generally rectangular fixtures that fit into a ceiling grid, so that they may be positioned as needed during setup of the office.

With the proliferation of high power solid state light sources that increasingly cost less and less, luminaires that use solid state light sources instead of conventional light sources are becoming more and more common. One such luminaire is a troffer-style fixture disclosed in U.S. Published Patent Application No. 2012/0051041, entitled "Troffer-style fixture" and published on Mar. 1, 2012. The '041 application discloses a troffer-type luminaire with solid state light sources arranged in one or two stripes, down the center of the fixture, directing light upward. Directly beneath the stripe or stripes is a heat sink, which dissipates heat from the solid state light sources.

SUMMARY

Conventional solid state light source-based troffer-type luminaires, such as described in regards to the '041 application above, suffers from a variety of deficiencies, namely that the heat sink located beneath the stripe or stripes of solid state light sources is opaque. Thus, the heat sink blocks some light radiated from the fixture, which results in a dark stripe through the center of the fixture and bright regions on either side of the dark stripe. This dark stripe is not aesthetically pleasing. Further, such a dark stripe is not found in troffer-style luminaires utilizing conventional light sources (e.g., fluorescent lamps), which the solid state light source-based luminaires seek to replace. These factors combined may lessen the acceptance and use of such luminaires.

Embodiments of the present invention provide a luminaire including solid state light sources, which may take the shape and form factor of a conventional troffer-type luminaire, and which provides light that extends fully across a viewing window of the luminaire, without a dark stripe down the center. Such a luminaire includes a downward-facing housing with a diffusely reflecting top side. The housing also includes at least one, and sometimes a pair of, specularly reflecting lateral side(s) extending generally downward from a respective edge of the top side. The housing also includes at least one light source mounting surface extending laterally inward from a respective bottom edge of the respective lateral side. A downward protrusion may be disposed in the center of the top side, which extends generally parallel to the lateral sides. A plurality of solid state light sources is disposed along the light source mounting surface(s) proximate to the lateral side(s). The solid state light sources emit light generally upward toward the top side. The lateral sides reflect light from the solid state light sources upward toward the top side. The top side then diffusely reflects the light downward, achieving a uniform light distribution without the presence of a dark stripe.

In an embodiment, there is provided a luminaire housing. The luminaire housing includes: a diffusely reflecting top side, the diffusely reflecting top side having an edge; at least one specularly reflecting lateral side extending generally downward from a respective edge of the diffusely reflecting top side; and at least one light source mounting surface extending laterally inward from a respective bottom edge of the respective at least one specularly reflecting lateral side.

In a related embodiment, the at least one specularly reflecting lateral side may include a pair of specularly reflecting lateral sides, and the at least one light source mounting surface may include a pair of horizontal light source mounting surfaces, each horizontal light source mounting surface extending across two opposing lateral edges of the luminaire housing. In a further related embodiment, for vertical cross-sectional slices of the luminaire housing taken perpendicular to the opposing lateral edges, the cross-sectional slices may be the same for all points along the opposing lateral edges. In a further related embodiment, the luminaire housing may be elongated along a direction generally parallel to the opposing lateral edges.

In another related embodiment, the diffusely reflecting top side may include a downward protrusion located at a center of the diffusely reflecting top side. In still another related embodiment, the diffusely reflecting top side, the at least one specularly reflecting lateral side, and the at least one light source mounting surface may be formed together such that at least one specularly reflecting lateral side, viewed from below the luminaire housing, shows a reflection of the diffusely reflecting top side. In yet another related embodiment, the luminaire housing may have a generally rectangular footprint, and the luminaire housing may include four reflecting lateral sides and four light source mounting surfaces, each extending across a side of the rectangular footprint. In still yet another related embodiment, the luminaire housing may have a generally round of freeform footprint, and the luminaire housing may include at least one reflecting lateral side following the generally round of freeform footprint of the luminaire housing and being generally perpendicular to the diffusely reflecting top side of the luminaire housing.

In yet still another related embodiment, the luminaire housing may further include a plurality of solid state light sources disposed along the at least one light source mounting surface, the plurality of solid state light sources emitting light generally upward toward the diffusely reflecting top side. In a further related embodiment, the solid state light sources in the plurality of solid state light sources may be spaced so as to produce a generally uniform illumination of light at the diffusely reflecting top side. In another further related embodiment, the plurality of solid state light sources may be grouped into a plurality of clusters, each cluster in the plurality of clusters having a first solid state light source that emits light of a first wavelength and a second solid state light source that emits light of a second wavelength, wherein the first wavelength and the second wavelength may be distinct. In a further related embodiment, the plurality of clusters may be spaced so as to produce substantially white light at the diffusely reflecting top side.

In yet still another related embodiment, the at least one specularly reflecting lateral side may include a plurality of specularly reflecting lateral sides, and the diffusely reflecting top side may be perpendicular to each specularly reflecting lateral side in the plurality of specularly reflecting lateral sides at the intersection of the diffusely reflecting top side and the respective specularly reflecting lateral side.

In another embodiment, there is provided a luminaire. The luminaire includes: a diffusely reflecting top side having opposing lateral edges and a center; a pair of specularly reflecting lateral sides extending generally downward from the opposing lateral edges of the top side, each specularly reflecting lateral side having a respective bottom edge; a downward protrusion in the center of the top side, the downward protrusion extending generally parallel to the pair of specularly reflecting lateral sides; a pair of light source mounting surfaces extending laterally inward from the respective bottom edges of the pair of specularly reflecting lateral sides; and a plurality of solid state light sources disposed along the pair of light source mounting surfaces proximate the pair of specularly reflecting lateral sides, the plurality of solid state light sources emitting light generally upward toward the diffusely reflecting top side, the pair of specularly reflecting lateral sides reflecting light emitted from the plurality of solid state light sources upward toward the diffusely reflecting top side.

In a related embodiment, an area between the pair of light source mounting surfaces may define a downward-facing window, through which light emitted by the plurality of solid state light sources and reflected off the diffusely reflecting top side may be visible. In a further related embodiment, the window may be formed within the luminaire such that the diffusely reflecting top side is visible through the window from directly below the window. In another further related embodiment, the window may be formed within the luminaire such that the diffusely reflecting top side may be visible through the window via reflection off at least one of the specularly reflecting lateral sides in the pair of specularly reflecting lateral sides from locations offset from directly below the window. In still another further related embodiment, the window may be elongated along the a pair of specularly reflecting lateral sides.

In another related embodiment, the diffusely reflecting top side may be perpendicular to each specularly reflecting lateral side in the pair of specularly reflecting lateral sides at an intersection of the diffusely reflecting top side and the respective specularly reflecting lateral side.

In an embodiment, there is provided a luminaire housing. The luminaire housing includes: a pair of light source mounting surfaces, each extending laterally outward from an inner edge to an outer edge; a pair of glossy reflective lateral sides, each extending generally upward from the outer edge of a corresponding one of pair of the light source mounting surfaces to a top edge; and a pair of arcs, each arc extending from a top edge of a corresponding one of the pair of glossy reflective lateral sides inward, such that the pair of arcs meet at a point that is centered between the pair of glossy reflective lateral sides, wherein an angle of each arc is located below the luminaire housing, wherein each of the pair of arcs is glossy reflective.

In a related embodiment, the pair of light source mounting surfaces may each be configured to receive a diffuser. In a further related embodiment, a set of solid state light sources may be disposed on the pair of light source mounting surfaces, such that light emitted therefrom is diffused by the diffuser upon exiting the luminaire housing. In a further related embodiment, a first subset of the set of solid state light sources may be disposed on one of the pair of light source mounting surfaces in proximity to its corresponding one of the pair of glossy reflective lateral sides, and a second subset of the set of solid state light sources may be disposed on the other of the pair of light source mounting surfaces in proximity to its corresponding one of the pair of glossy reflective lateral sides.

In another further related embodiment, the set of solid state light sources may be enclosed behind a pair of windows, each window in the pair of windows extending from a corresponding one of the pair of light source mounting surfaces towards a corresponding one of the pair of arcs. In a further related embodiment, each of the pair of glossy reflective lateral sides and each of the pair of arcs may be coated with one of a semi-gloss paint, a satin paint, or an eggshell paint.

In yet another related embodiment, each of the pair of glossy reflective lateral sides and each of the pair of arcs may be coated with high reflectivity glossy paint. In still another related embodiment, each of the pair of arcs is a partial parabolic curve. In a further related embodiment, a focus of a parabola defined at least in part by one of the partial parabolic curves may be located exterior to one of the pair of glossy reflective lateral sides.

In yet still another related embodiment, each of the pair of arcs may be formed by a series of curves. In a further related embodiment, each of the series of curves may be formed by a corresponding set of connected straight line segments, such that each corresponding set of connected straight line segments approximates one of the pair of arcs.

In still yet another related embodiment, each of the arcs in the pair of arcs may have an internal surface that faces one of the pair of light source mounting surfaces and an opposing external surface, and one of the pair of arcs may be configured to receive a power supply on its external surface. In yet still another related embodiment, the pair of light source mounting surfaces, the pair of glossy reflective lateral surfaces, and the pair of arcs may be integrally formed.

In another embodiment, there is provided a luminaire. The luminaire includes: a luminaire housing, including: a pair of light source mounting surfaces, each extending laterally outward from an inner edge to an outer edge; a pair of glossy reflective lateral sides, each extending generally upward from the outer edge of a corresponding one of pair of the light source mounting surfaces to a top edge; and a pair of arcs, each arc extending from a top edge of a corresponding one of the pair of glossy reflective lateral sides inward, such that the pair of arcs meet at a point that is centered between the pair of glossy reflective lateral sides, wherein an angle of each arc is located below the luminaire housing, wherein each of the pair of arcs is glossy reflective; and a set of solid state light sources disposed on the pair of light source mounting surfaces and configured to emit light towards the pair of glossy reflective lateral sides and the pair of arcs, wherein a portion of the emitted light is specularly reflected and shaped by the angle of one of the pair of arcs, and wherein a portion of the emitted light is diffusely reflected, prior to exiting the luminaire.

In a related embodiment, the luminaire may further include a diffuser, the diffuser may be connected to the luminaire at the pair of light source mounting surfaces. In another related embodiment, the pair of light source mounting surfaces may be a single, integrally formed surface made of a diffusive material. In a further related embodiment, the luminaire may further include a pair of windows behind which are enclosed the set of solid state light sources, each window in the pair of windows extending from the single, integrally formed surface towards a corresponding one of the pair of arcs.

In yet another related embodiment, each of the arcs in the pair of arcs may have an internal surface that faces one of the pair of light source mounting surfaces and an opposing external surface, and one of the pair of arcs may include a power supply enclosure, configured to receive a power supply, on its external surface.

In still another related embodiment, the pair of arcs may include: a pair of arcs, each arc extending from a top edge of a corresponding one of the pair of glossy reflective lateral sides inward, such that the pair of arcs meet at an angled reflector that is centered between the pair of glossy reflective lateral sides, wherein an angle of each arc is located below the luminaire housing, wherein each of the pair of arcs is glossy reflective, and wherein the angled reflector is glossy reflective.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Throughout this application, the directional terms "up", "down", "upward", "downward", "top", "bottom", "side", "lateral", "longitudinal" and the like are used to describe the absolute and relative orientations of particular elements. For example, some embodiments herein refer to a "top" side of a luminaire housing that includes a diffuse reflector and a "bottom" of a luminaire housing through which light exits the luminaire housing. In this example, "top" and "bottom" are used to indicate the typical orientations when the luminaire is installed and operational, typically mounted in a ceiling or as part of a ceiling grid. It is understood that these orientational terms are used only for convenience, and are not intended to be limiting. Thus, when a luminaire according to embodiments described herein is, for example, packaged in a box, resting on a counter, leaned up against a wall, or in various stages of assembly on an assembly line, the luminaire may be positioned in any orientation but will still have a "top" side that includes a diffuse reflector and a "bottom" through which light would exit the luminaire, were it powered and operating. In other words, the orientational terms are used for ease of description and may be used regardless of the actual orientation of the luminaire at a given point in time.

Embodiments of a luminaire are described throughout as being "downward-facing", for ease and convenience of description, however, embodiments are not so limited. That is, a luminaire according to embodiments is useable in any orientation. The luminaire includes a housing with a diffusely reflecting top side, at least one specularly reflecting lateral side extending generally downward from a respective edge of the top side, and at least one light source mounting surface extending horizontally inward from a respective bottom edge of the respective lateral side. In some embodiments, the luminaire includes two or more reflecting lateral sides and two or more light source mounting surfaces, each extending along opposing lateral edges of the housing. In some embodiments, the top side of the housing has a downward protrusion at its center, optionally extending parallel to the lateral sides. As an advantage, the specularly reflecting lateral side(s)s may give an illusion of a light-emitting surface (i.e., the diffusely reflecting top side of the housing) that appears to extend laterally farther than it actually does.

Figure 1:
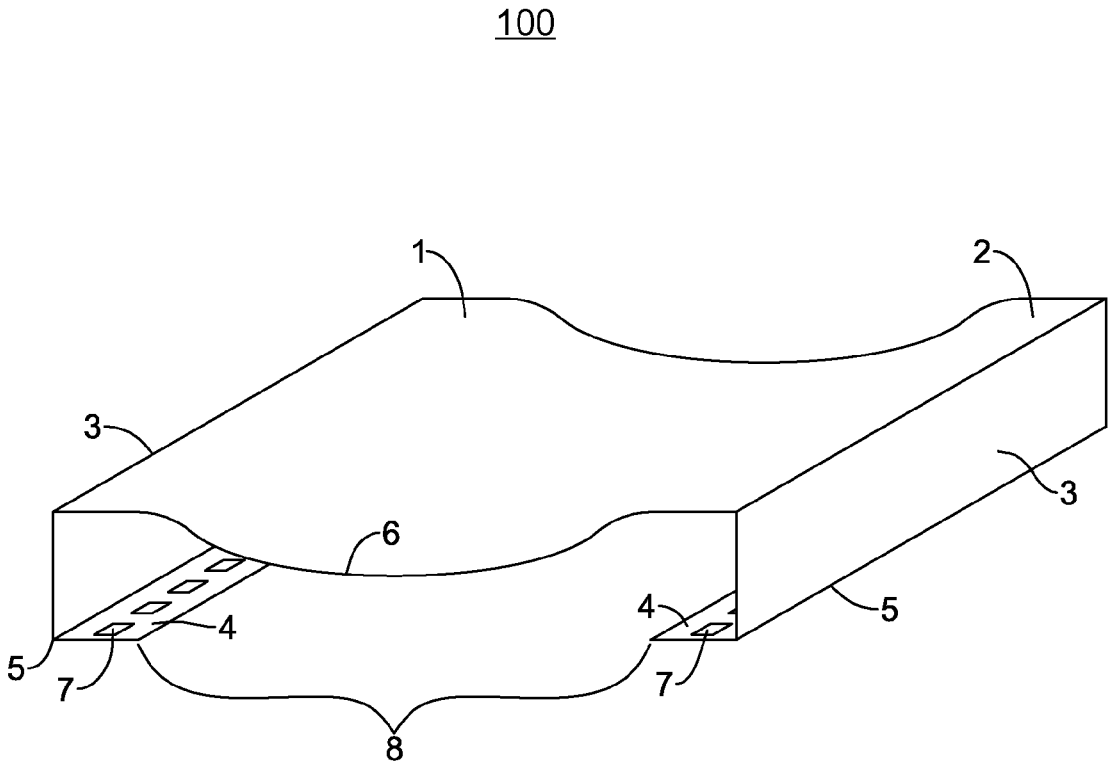
FIG. 1 is plan drawing of a downward-facing luminaire including solid state light sources, viewed from slightly above, according to embodiments disclosed herein.
Figure 2:
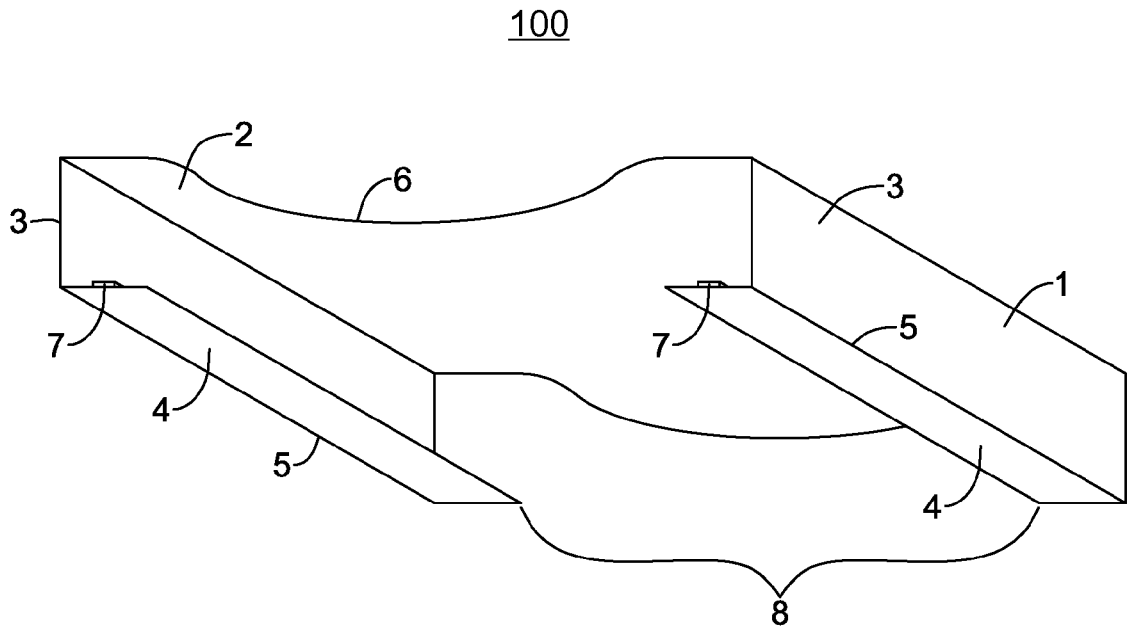
FIG. 2 is plan drawing of the downward-facing luminaire of FIG. 1, viewed from slightly below, according to embodiments disclosed herein.

FIGS. 1 and 2 are plan drawings of a downward-facing luminaire 100, viewed from slightly above (FIG. 1) and slightly below (FIG. 2), respectively. Elements in these two figures share a common description. In FIGS. 1 and 2, the orientation of the luminaire 100 corresponds roughly to being mounted within a ceiling grid. The top and bottom of the figures are intended to represent up and down, respectively. Light exits the luminaire propagating "downward", that is, toward the bottom of the figures. Note that only optical elements are shown in FIGS. 1 and 2. Related electronics, structural support, and optional exiting window are generally well known to one of ordinary skill in the art of luminaires, and are thus not shown in the figures.

The luminaire 100 includes a housing 1. In some embodiments, the housing 1 defines a portion of the structure of the luminaire 100, while in other embodiments, the housing 1 defines the entirety of the structure of the luminaire 100. The housing 1 includes a top side 2, having an outer surface (i.e., a surface that is visible from the top of the luminaire 100) and an inner surface (i.e., a surface is visible from the bottom of the luminaire 100). The top side 2, and in some embodiments more particularly the inner surface of the top side 2, is diffusely reflecting. The top side 2, and in some embodiments the inner surface of the top side 2, is made of one or more diffusely reflecting materials. Alternatively, in some embodiments, the top side 2, and in some embodiments the inner surface of the top side 2, is coated with one or more diffusely reflecting coatings. In other embodiments, the top side 2, and in some embodiments the inner surface of the top side 2, is partially formed of one or more diffusely reflecting materials and partially coated with one or more diffusely reflecting coatings. In some embodiments, the top side 2 is light-colored, preferably white and/or substantially white, but not so limited, so that the top side 2, and in some embodiments the inner surface of the top side 2, reflects incident light. In addition, the top side 2, and in some embodiments the inner surface of the top side 2, is roughened and/or substantially roughened, rather than smooth, so that reflected light scatters and leaves the top side 2, and in some embodiments the inner surface of the top side 2, with a randomized direction. In general, the more rough a surface, the higher the degree of randomization of light in the exiting direction from the surface. In the extreme case of a perfectly smooth surface, the perfectly smooth surface reflects specularly, where the angle of incidence equals the angle of reflection, both with respect to a surface normal. Typically, a top side 2 that was specularly reflecting would be undesirable with, for example, light emitting diodes, as the specular reflection, when viewed from below, would show certain spots as brighter than other spots. By using a diffuse reflection instead, in embodiments including light emitting diodes and other similar solid state light sources, any such bright spots are completely or largely obscured.

The top side 2 shown in FIGS. 1 and 2 is rectangular in shape when viewed in a two-dimensional plane from directly above or directly below the luminaire 100. The top side 2 in FIGS. 1 and 2 has an elongation along the direction parallel to each of two lateral sides 3. Of course, in some embodiments, the elongation is in the other direction. In other embodiments, the top side 2 takes on other shapes when in the same way as described above, such as but not limited to squares, hexagons, octagons, polygons, circles, ellipses, ovals, generally polygonal shapes with rounded corners, and so forth.

Figure 15:
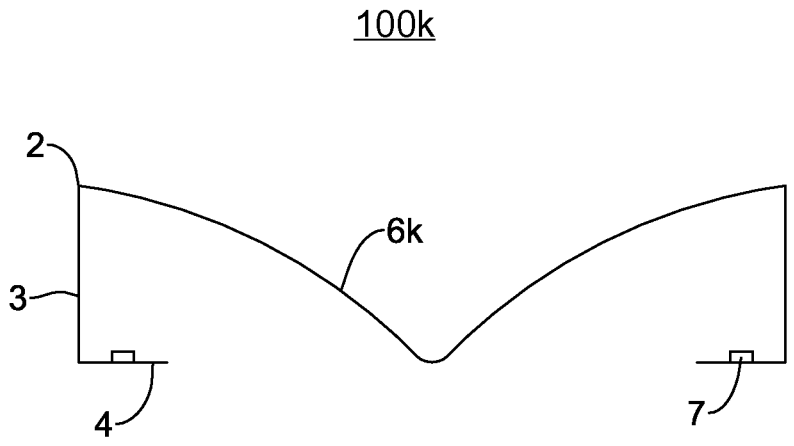
Figure 16:
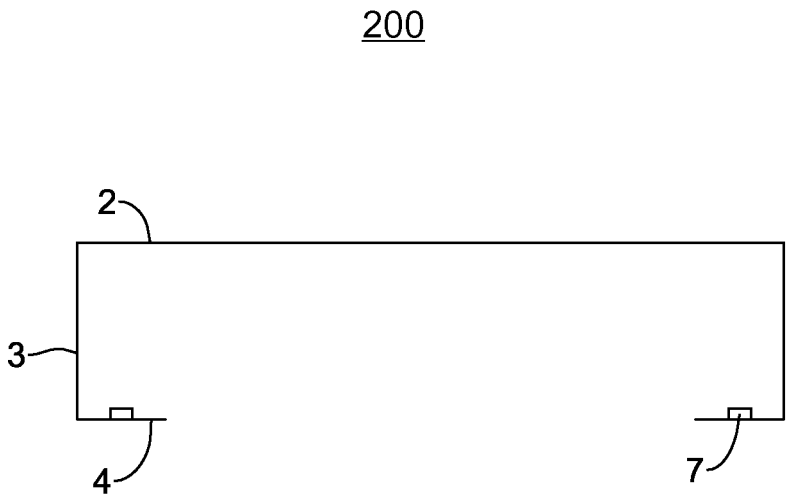
FIG. 16 is an end-on schematic drawing of an example downward-facing luminaire having a flat top side of the housing.

In some embodiments, such as the luminaire 200 shown in FIG. 16, the top side 2 is flat/substantially flat. In other embodiments, such as shown in FIGS. 1, 2, and 4-15, the top side 2 has a non-flat topography. In such embodiments, the top side 2 includes one or more protrusions. The choice of topography for the top side 2 is based on a variety of factors, including but not limited to the shape of the top side 2, the size of the top side 2, the number and/or type of light sources used in the luminaire 100, the desired illumination pattern of light output by the luminaire 100, and so on.

In FIGS. 1 and 2, the top side 2 includes a protrusion 6, which may (among other things) provide a more uniform illumination of light output by the luminaire 100. In some embodiments, the protrusion is located in the center, and/or substantially in the center, of the top side 2. In some embodiments, the protrusion is located in another portion of the top side 2. The another portion of the top side 2 in which the protrusion is located overlaps at least in part with the center of the top side 2, in some embodiments, and does not so overlap in other embodiments. In FIGS. 1 and 2 (among others), the protrusion 6 extends in a substantially downward direction, that is, towards where light exits the luminaire 100. In some embodiments, the protrusion extends in an upward direction and/or in a substantially upward direction. Alternatively, or additionally, in some embodiments, the protrusion extends in a plurality of directions. Embodiments including different types of protrusions 6 are described in greater detail below with regards to FIGS. 5-15.

Using a downward/substantially downward protrusion, as shown in FIGS. 1 and 2, provides a number of optical benefits for light output by the luminaire 100. On the downward protrusion 6 shown in FIGS. 1 and 2, the angle of incidence is reduced, bringing the surface closer to normal incidence and raising the effective incident power per unit area. Further, on the downward protrusion 6, the top side 2 is brought closer to the light sources used in the luminaire 100 (such as but not limited to the solid state light sources 7 shown in FIGS. 1 and 2), which also raises the effective incident power per unit area. Ultimately, a higher effective incident power per unit area at the top side 2 leads to a brighter appearance from the diffusely reflected light at the top side 2.

In some embodiments disclosed herein, the protrusion 6 extends generally cylindrically along a length of the top side 2. More precisely, for vertical cross-sectional slices of the top side 2 taken perpendicular to the opposing lateral sides 3 (i.e., parallel to the plane of the page in FIGS. 1 and 2), the cross-sectional slices are the same for all points along the opposing lateral sides 3. This cross-sectional constraint may also hold for the entire housing 1 of the luminaire 100, and not just the protrusion 6. A cross-section of the particular downward protrusion 6 of FIGS. 1 and 2, taken perpendicular to the opposing lateral sides 3, shows four particular features. First, the top side 2 is generally perpendicular to the lateral side 3 at their point of intersection. Second, the top side 2 includes a flat portion directly adjacent to the lateral side 3. Third, there is rounding between the flat portion and an adjacent curved portion (i.e., no sharp corner). Fourth, there is a flat/substantially flat bottom to the curved portion at the lateral center of the top side 2 (i.e., no sharp corner). Of course, the features found in a particular protrusion may vary depending on the size and/or shape of that protrusion.

The luminaire housing 1 also includes a pair of lateral sides 3 that are connected to the top side 2. In some embodiments, the luminaire 100 includes only a single lateral side 3. In some embodiments, more lateral sides 3 are used. At least one lateral side 3, and in some embodiments each of the pair of lateral sides 3, extend downward from the top side 2. In some embodiments, some number of the lateral sides 3 extend in a different direction in relation to the top side 2. In some embodiments, some number of the lateral sides 3 extend in more than one direction in relation to the top side 2, for example but not limited to both upward and downward. Each lateral side includes at least two surfaces, an inner surface that faces the diffusely reflecting surface of the top side 2 and an outer surface that faces in the opposite direction. At least one, and in some embodiments both, of the pair of lateral sides 3 are specularly reflecting, on at least its(their) respective inner surfaces, in contrast with the diffuse reflection of the top side 2. In some embodiments, such as shown in FIGS. 1 and 2, the lateral sides 3 are straight, flat, and perpendicular to the top side 2. These straight, flat and perpendicular lateral sides 3, through specular reflection, form an undistorted virtual image of the top side 2 that appears to be a lateral extension of the top side 2, which may be aesthetically pleasing. In other embodiments, the lateral sides 3 may include some curvature and/or some roughness, on one or more than one of the at least two surfaces of each lateral side 3. For example, if a footprint of the top side 2 is rounded, the lateral sides 3 may follow the rounding of the footprint. In some embodiments, the shape of the lateral sides 3 is described as a generalized cylinder, and of course, any known shape may be, and in some embodiments is, used.

A lateral side 3 (and in some embodiments, each of the pair of lateral sides 3) includes a light source mounting surface 4 attached and/or otherwise connected and/or adjacent thereto. In some embodiments, the light source mounting surface extends along the full length of the lateral side 3 to which it is attached/connected/adjacent thereto. In some embodiments, the light source mounting surface extends along only a portion of lateral side 3. In some embodiments, a plurality of light source mounting surfaces 4 are located along the lateral side 3. The plurality of light source mounting surfaces 4 may be arranged in any known way, for example but not limited to abutting, overlapping, with space in between, and any combinations thereof. As shown in FIGS. 1 and 2, the light source mounting surface 4 extends from a lateral edge of the lateral side 3, inwardly from the lateral side 3 (i.e. towards the space faced by the diffusely reflecting surface of the top side 2). In some embodiments, the light source mounting surface 4 extends inwardly from the lateral side 3, perpendicular to the lateral side 3, and is flat. In some embodiments, the light source mounting surface 4 extends inward a small distance (for example but not limited to an inch) in relation to the length of the top side 2. In some embodiments, the light source mounting surface extends inward at an angle. In some embodiments, the light source mounting surface includes some amount of curvature. In some embodiments, the light source mounting surface also extends outwardly (i.e. away from) the lateral side 3. In some embodiments, the luminaire housing 1, including the top side 2, each lateral side 3, and each light source mounting surface 4, is made from a single piece of material, for example but not limited to by extrusion. In some embodiments, the luminaire housing 1 is formed by joining together one or more separate pieces, which include the top side 2, each lateral side 3, and each light source mounting surface 4, either all separate or some joined in some combination prior to being joined to form the luminaire housing 1.

At least one light source 7 is mounted on a light source mounting surface 4. In some embodiments, the at least one light source 7 is mounted closer to the lateral side 3 nearest the light source mounting surface 4. In some embodiments, the at least one light source 7 is mounted farther away from that lateral side. In some embodiments, the at least one light source 7 is mounted centrally on the light source mounting surface 4. In some embodiments, each light source mounting surface 4 in the luminaire 100 includes at least one light source 7, as shown in FIGS. 1 and 2. In some embodiments, a first light source mounting surface 4 includes at least one light source 7 while a second light source mounting surface 4 does not include any light source. In some embodiments, the light source 7 is a solid state light source. A solid state light source may, and in some embodiments does, include one or more light emitting diodes (LEDs), one or more organic light emitting diodes (OLEDs), one or more polymer light emitting diodes (PLEDs), and the like, and/or any combinations thereof, arranged in any known configurations, such as but not limited to one or more dies on a substrate, bare or packaged in a chip, one or more chips, one or more modules including one or more bare dies or packaged dies or chips or any combination(s) thereof, and combinations thereof, connected and/or interconnected in any known way, and emitting light of any known color (i.e., having a particular wavelength and/or combination of wavelengths, and thus including white light). Thus, in some embodiments, the light source 7 includes more than one solid state light source. Of course, in some embodiments, other light sources may also be used. With a plurality of light sources 7, each light source 7 in the plurality of light sources 7 is, in some embodiments, mounted on the light source mounting surface 4 at the same distance from the lateral side 3, while in other embodiments, at least a first light source 7 in the plurality of light sources 7 is mounted on the light source mounting surface 4 at a different distance from the lateral side 3 than at least a second light source 7 in the plurality of light sources 7.

The light source 7, whether including a single light source or a plurality of light sources, emits light upward toward the top side 2 of the luminaire housing 1, where it is diffusely reflected downward out of the luminaire housing 1. Because the lateral sides 3 of the luminaire housing 1 are specularly reflecting, if one looks at the lateral sides 3 from underneath the luminaire 100, one sees a reflection of the top side 2 and the scattered light emitted by the light source 7 therefrom. Basically, the reflective lateral sides 3 give the illusion that the light-scattering top side 2 appears to extend laterally farther than it actually does, which is aesthetically pleasing.

A second aesthetic function of the specularly reflective lateral sides 3 is to hide the presence, spacing and color variation of the light source(s) 7, particularly when the light source 7 is one or more solid state light sources. If the lateral sides 3 were made with diffuse reflectors, a bright plume of light would be visible directly adjacent to each solid state light source. Spaces in between each plume would be relatively dark and any color differences (intentional or unintentional) in the light emitted by respective solid state light sources would be visible in the plumes. This aesthetic function occurs because the reflection of light from the specular surface is undetectable from below. Only when it reaches the top surface is any part of it scattered in the downward direction toward an observer. In propagating this distance, the rays of light from several solid state light sources blend together to become relatively uniform.

In some embodiments, there is an empty space between the light source mounting surfaces 4. This space may be, and in some embodiments is, defined as a downward-facing window 8. The downward-facing window 8, in some embodiments, includes a physical piece of glass and/or plastic, and in some embodiments, this physical piece is itself a diffuser and/or is coated with a diffusive material. In some embodiments, the window 8 is simply an opening, defined on at least one lateral edge by a light source mounting surface 4, and the light emitted from the luminaire 100 exits through the window 8.

Figure 3:
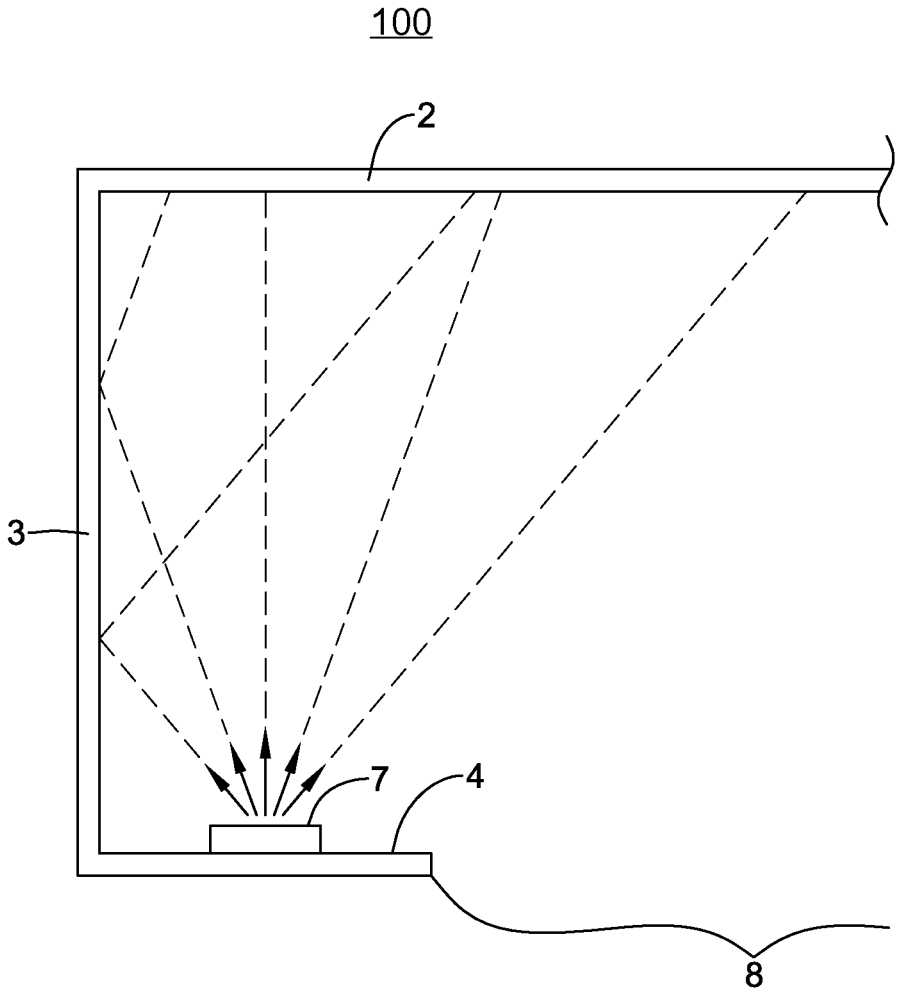
FIG. 3 is a cross-sectional schematic of the downward-facing luminaire of FIGS. 1 and 2, showing ray paths from solid state light sources to a top side of the luminaire, according to embodiments disclosed herein.

FIG. 3 shows a cross-section of the luminaire 100, including a lateral side 3, a portion of the top side 2, a light source mounting surface 4, a light source 7, and a portion of the window 8. For clarity only, any curvature in any portion of the luminaire housing 1 is omitted. The cross-section of FIG. 3 is taken perpendicular to the lateral sides 3 of the luminaire housing 1, such that only one light source 7 is visible. The cross-section of FIG. 3 also includes the ray paths (i.e. light rays) from the solid state light source 7 to the top side 2 of the luminaire housing 1. The light source 7 is mounted on the light mounting surface 4 face-up. The plane of the solid state light source 7 is parallel to the light source mounting surface 4, or roughly horizontal, although in some embodiments there may be some tilt between the solid state light source 7 and the light source mounting surface 4, or tilt between either of those elements and true horizontal. Light from the solid state light source 7 has an angular distribution centered around a roughly vertical surface normal, with most of the light propagating vertically away from the solid state light source 7, and a decreasing amount of light at increasing angles away from normal exitance. As shown by the dashed lines in FIG. 3, light traveling upwards or to the right directly strikes the top side 2 of the housing 1, while light traveling to the left reflects specularly off the lateral side 3 before striking the top side 2.

Figure 4:
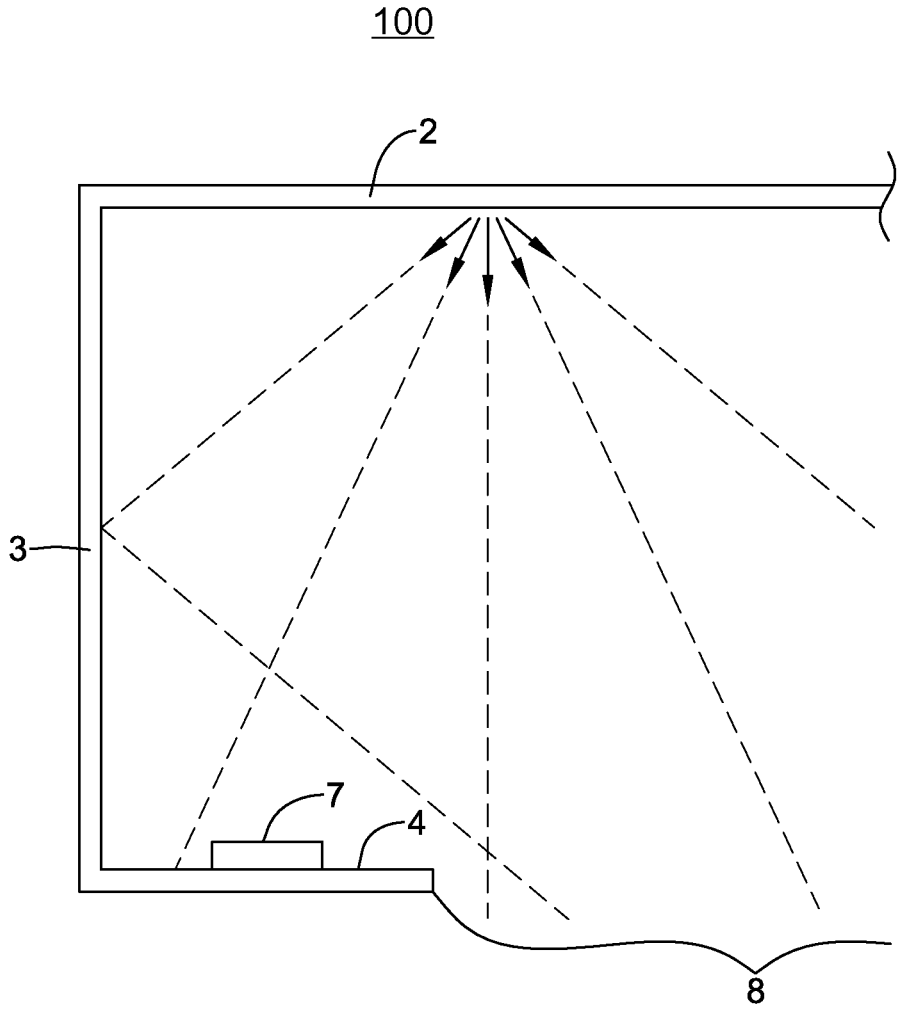
FIG. 4 is a cross-sectional schematic of the downward-facing luminaire of FIGS. 1 and 2, showing ray paths from the top side of the luminaire then exiting the luminaire, according to embodiments disclosed herein.

FIG. 4 shows the same cross-section of the luminaire 100 as FIG. 3, but now shows the ray paths from the top side 2 as light exits the luminaire 100. In general, the scattering/diffusing properties are generally the same all over the top side 2, so that the emission pattern from any one point on the inner surface of the top side 2 is generally the same as the emission pattern from any other point. For this reason, it is generally desirable that the amount of power per area incident on the top side 2 be generally uniform or within a particular tolerance, over a particular area on the top side 2. As shown by the dashed lines in FIG. 4, light may exit through the window 8 directly, light may reflect specularly off the lateral side 3, and/or light may strike the light source mounting surface 4. In some embodiments, it is desirable to make the light source mounting surface 4 as small as is practical, in order to minimize the amount of light that it blocks from exiting through the window 8. In some embodiments, the light source mounting surface 4 is coated with and/or made from a reflective material itself, to further enhance the amount of light emitted by the luminaire 100. In some embodiments, the light source mounting surface 4 is itself diffusely reflective, similar to the top side 2. In some embodiments, the light source mounting surface 4 is itself specularly reflective, similar to the lateral side 3.

Note that for an observer who looks at the lateral side 3, the observer will see a virtual image of the top side 2. The concatenation of the virtual image of the top side 2, being disposed directly adjacent to the actual top side 2, may give the desirable illusion that the top side 2 appears to extend laterally farther than it actually does.

Regarding the number of placement of light sources 7 on the light source mounting surface 4, there is a trade-off between uniformity of brightness at the top side 2, and economy in using as few light sources 7 as possible. Light emitted from a solid state light source propagates a certain distance to the top side 2. Thus, some of the peaks and valleys in the intensity pattern will be blurred out at the top side 2. In some embodiments, there is a particular threshold value for spacing of solid state light sources, beyond which the peaks and valleys become undesirably large. This threshold is easily found when simulating the design the luminaire 100, typically before any parts are built. There are several known ray-tracing programs that are commonly used to simulate the performance of a luminaire, such as the luminaire 100, and to optimize the luminaire housing 1 and light source layout and geometry. For example, the program Lucidshape is computer aided designing software for lighting design tasks, and is commercially available from the company Brandenburg GmbH, located in Paderborn, Germany. Other known computer software and/or sources may also be used.

In some embodiments, the light emitted by the luminaire 100 is white light/substantially white light. As is known in the art, white light is produced from solid state light sources in at least two ways. A first way involves the use of a yellow phosphor in combination with blue light from the solid state light source(s). In embodiments using such a phosphor and solid state light sources, the phosphor is located, for example, on the top side 2 of the luminaire housing 1, or on the solid state light sources 7 themselves. The second way is to use a combination of two or more colors of light, emitted from corresponding solid state light sources, known as color mixing. Well-known color mixing combinations include red, green, blue, and red and green, among others. These combinations may be adjusted during production of the luminaire 100, in some embodiments, or may be adjustable after production, in some embodiments. The spacing of the solid state light sources is such that white light is seen at the top side 2 of the luminaire housing 1.

Any or all of the reflective or support surfaces of the luminaire 100 may be, and in some embodiments are, made integrally with other surfaces, or may be, and in some embodiments are, made separately and attached to other surfaces. In some embodiments, the top side 2, the lateral sides 3, and the light source mounting surfaces 4 are all be formed from the same piece of metal or plastic. In some embodiments, the specularly reflective material of the lateral sides 3 is a specular laminate on a diffuse material. In some embodiments, the top side 2 and the lateral sides 3 are made from the same material, but with a change in surface finish. Likewise, in some embodiments, the light source mounting surfaces 4 are made separately, optionally from a different material, and are attached by screws, adhesive, a snap-connection, or by any other means to respective lateral sides 3. In some embodiments, the edge formed between the top side 2 and a lateral side 3 is an actual edge between two different materials, while in some embodiments, the edge is simply a change in material or a change in layered materials, rather than a real edge between discrete parts. Regardless of which elements are made integrally and which are made separately and attached afterward, the luminaire 100 includes the luminaire housing 1 having the top side 2, the lateral sides 3 and the light source mounting surfaces 4.

FIGS. 5-15 are various embodiments showing a variety of different shapes for a top side 2 of a variety of luminaires 100*a*-100*k*, including eleven different shapes for the protrusion 6 shown in FIGS. 1 and 2. In the luminaires 100*a*-100*k* of FIGS. 5-15, the basic geometry of the lateral sides 3, the light source mounting surfaces 4, and the light sources 7 are all the same as the luminaire 100 shown in FIGS. 1 and 2. FIGS. 5-15 are not meant to capture or describe every possible protrusion usable on the top side 2 of a luminaire according to embodiments described herein, but rather are meant to demonstrate one or more features that may be, and in some embodiments are, found in a luminaire as disclosed throughout, either alone or in any combinations.

Figure 5:
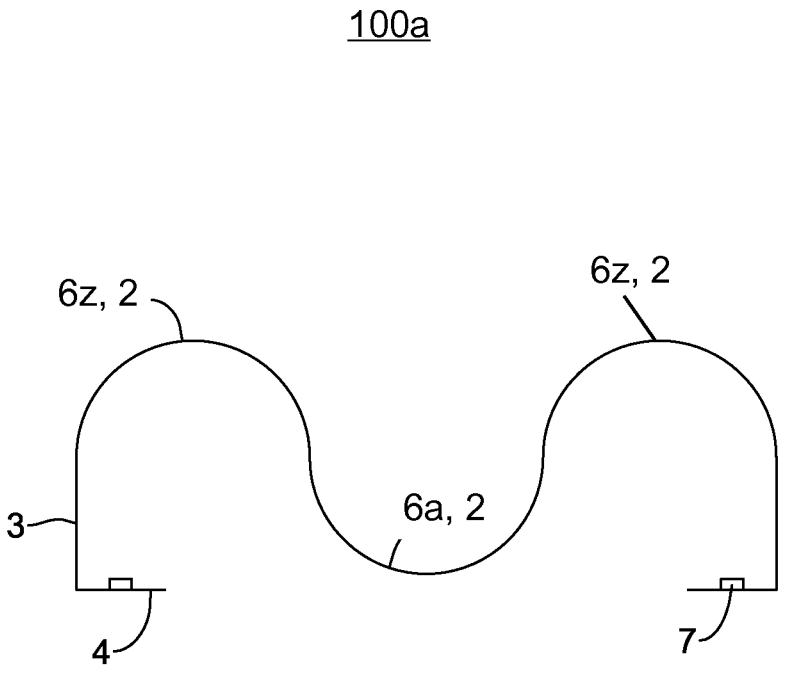
FIGS. 5-15 are schematic drawings of a variety of downward-facing luminaires, having a variety of differently shaped downward protrusions in their respective top sides, according to embodiments disclosed herein.

FIG. 5 shows a cross-section of a luminaire 100*a*, taken perpendicular to the opposing lateral sides 3. The luminaire 100*a* includes a top side 2 having a downward protrusion 6*a* and two upward protrusions 6*z*. The top side 2 forms an obtuse angle with each lateral side 3 at their respective points of intersection, as measured from the inside of the luminaire 100*a*. Each upward protrusion 6*z* is curved such that, when viewed in the cross-section shown in FIG. 5, the upward protrusion 6*z* looks like a half circle. In other words, each upward protrusion 6*z* looks like an arc having the length of a half circle. Each upward protrusion 6*z* is directly adjacent to its respective lateral side 3, and the downward protrusion 6*a* is located between the two upward protrusions 6*z*. The downward protrusion 6*a* is also curved, such that, when viewed in the cross-section shown in FIG. 5, the downward protrusion 6*a* looks like a half circle that is slightly offset on each side from each upward protrusion 6*z*. Thus, the curve that forms the downward protrusion 6*a*, when viewed in the cross-section of FIG. 5, has an arc length that is equal to, and in some embodiments substantially equal to, the arc length of each of the upward protrusions 6*z*. Thus, there are no sharp corners found on the top side 2 or between each lateral side 3 and the top side 2. In some embodiments, a central portion of the downward protrusion 6*a* is rounded, while in other embodiments, the central portion of the downward protrusion is slightly flattened. In some embodiments, the downward protrusion 6*a* extends past the light source mounting surfaces 4, and in other embodiments, the downward protrusion 6*a* extends at most up to the light source mounting surfaces 4. In some embodiments, the downward protrusion 6*a* extends to the light source mounting surfaces 4.

Figure 6:
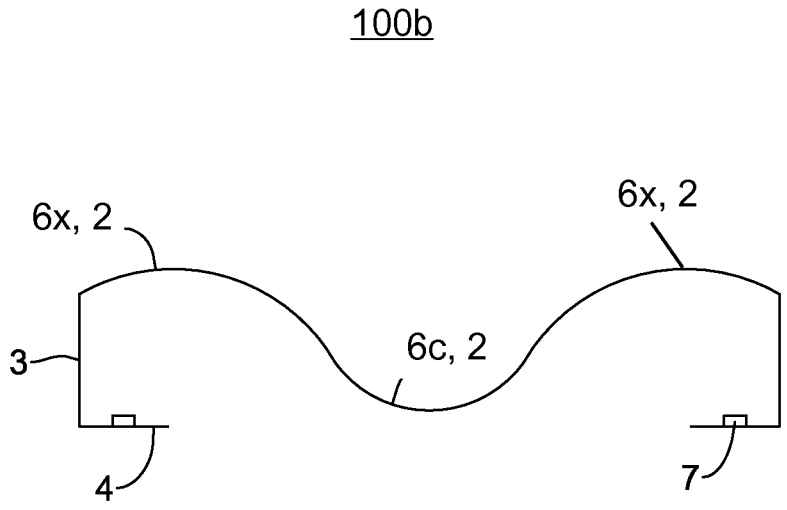

FIG. 6 shows a cross-section of a luminaire 100*b*, taken perpendicular to the opposing lateral sides 3. The luminaire 100*b* is similar to the luminaire 100*a* of FIG. 5, in that the luminaire 100*b* includes a downward protrusion 6*c* and two upward protrusions 6*x*. The luminaire 100*b* differs in that the curved shaped of each upward protrusion 6*x*, when viewed in the cross-section of FIG. 6, is an arc that is smaller than a half circle, and the arc length of the downward protrusion 6*c* is different from the arc length of the two upward protrusions 6*x*. As with the luminaire 100*a* shown in FIG. 5, the top side 2 forms an obtuse angle with each lateral side 3 at their respective points of intersection, as measured from the inside of the luminaire 100*b*, and there are no sharp corners found on the top side 2 or between each lateral side 3 and the top side 2. The bottom of the downward protrusions 6*c*, in some embodiments, extends at least as far as the light source mounting surfaces 4, in other embodiments, extends no further than the light source mounting surfaces 4.

Figure 7:
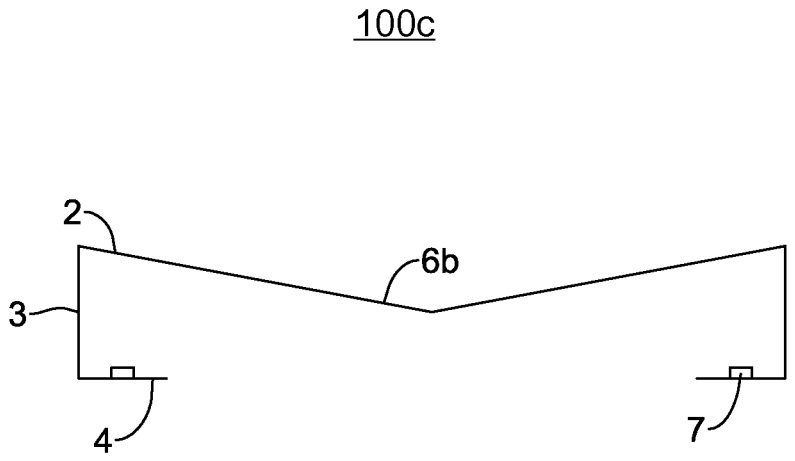

FIG. 7 shows a cross-section of a luminaire 100*c*, taken perpendicular to the opposing lateral sides 3. The luminaire 100*c* includes a top side 2 having a downward protrusion 6*b* formed of two angled flat portions meeting in a location that is below the center of the top side 2 at an angle that is less than 180° when measured from the outside of the luminaire 100*c*. The top side 2 forms an acute angle with each lateral side 3 at their respective points of intersection, as measured from the inside of the luminaire 100*c*. The downward protrusion 6*b* shown in FIG. 7 does not extend past the light source mounting surfaces 4, though in some embodiments, it does.

Figure 8:
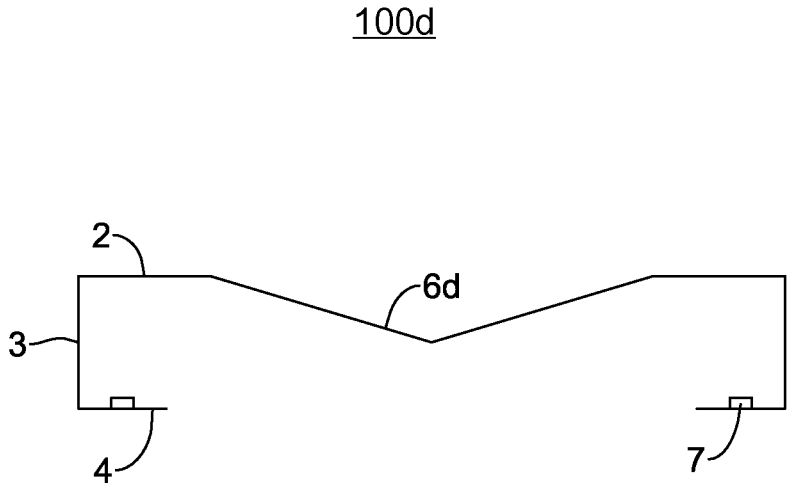

FIG. 8 shows a cross-section of a luminaire 100*d*, taken perpendicular to the opposing lateral sides 3. The luminaire 100*d* is similar to the luminaire 100*c* shown in FIG. 7, in that it includes a downward protrusion 6*d* that is formed of two angled flat portions meeting in a location that is below the center of the top side 2 at an angle that is less than 180° when measured from the outside of the luminaire 100*d*. In contrast to the luminaire 100*c* of FIG. 7, however, the top side 2 of the luminaire 100*d* also includes two flat laterally extending portions, each one between the edge of the top side 2 and an edge of a lateral side 3, and an angled flat portion of the downward protrusion 6*d*. This results in an obtuse angle between each flat laterally extending portion of the top side 2 and its respective angled flat portion of the downward protrusion 6*d*, when measured from the inside of the luminaire 100*d*. This also results in the top side 2 forming a right angle with each lateral side 3 at their respective points of intersection.

Figure 9:
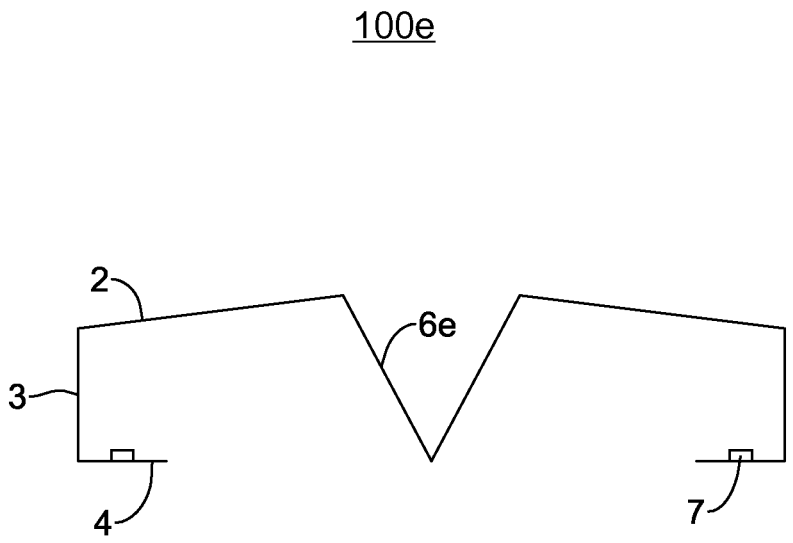

FIG. 9 shows a cross-section of a luminaire 100*e*, taken perpendicular to the opposing lateral sides 3, that is similar to the luminaire 100*d* of FIG. 8, in that the top side 2 of the luminaire 100*e* includes a downward protrusion 6*e* that is formed of two angled flat portions meeting in the center of the top side 2 at an angle that is less than 180° when measured from the outside of the luminaire 100*d*, and the top 2 side of the luminaire 100*e* includes two flat laterally extending angled portions, each one between the edge of the top side 2 and an edge of a lateral side 3, and an angled flat portion of the downward protrusion 6*e*. That is, while in FIG. 8 each flat laterally extending portion of the top side 2 is parallel the light source mounting surface 4 of the luminaire 100*d* that is below it, and thus forms a right angle with its respective lateral side 3, in the luminaire 100*e* of FIG. 9, the flat laterally extending angled portion is angled so as to form an obtuse angle with the its respective lateral side 3, measured from the interior of the luminaire 100*e*.

Figure 10:
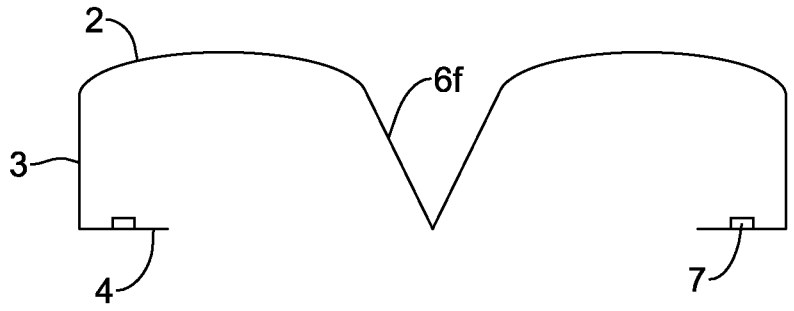

FIG. 10 shows a cross-section of a luminaire 100*f*, taken perpendicular to the opposing lateral sides 3. The luminaire 100*f* includes a downward protrusion 6*f* that is formed of two angled flat portions meeting in the center of the top side 2 at an angle that is less than 180° when measured from the outside of the luminaire 100*f*. The remainder of the top side 2 on each side of the downward protrusion 6*f* is formed of a curved portion that has an arc length that is less than that of a half circle, and forms an obtuse angle with both the lateral side 3 and the downward protrusion 6*f* when measured from the inside of the luminaire 100*f*.

Figure 11:
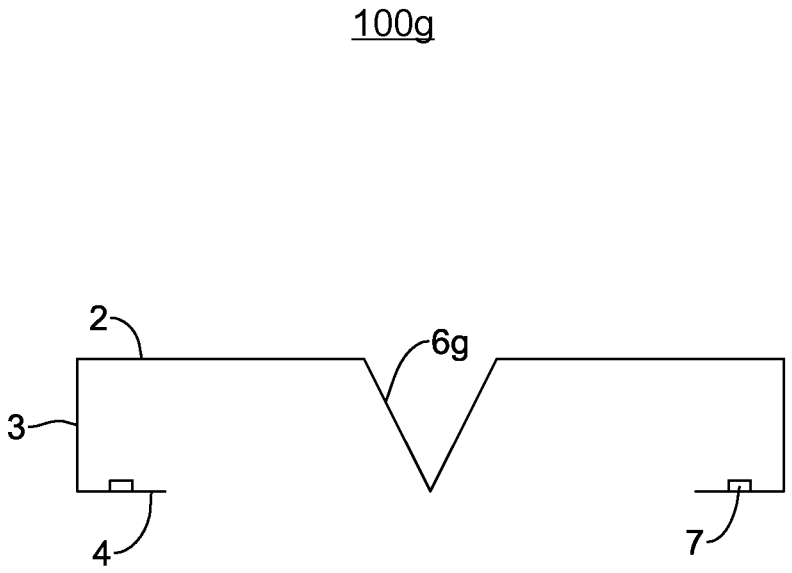

FIG. 11 shows a cross-section of a luminaire 100*g*, taken perpendicular to the opposing lateral sides 3, that is similar to the luminaire 100*d* of FIG. 8, in that the luminaire 100*g* includes a downward protrusion 6*g* that is formed of two angled flat portions meeting in a location below the center of the top side 2 at an acute angle when measured from the outside of the luminaire 100*d* and two flat laterally extending portions, each one between the edge of the top side 2 and an edge of a lateral side 3, and an angled flat portion of the downward protrusion 6*g*. Each flat laterally extending portion has a length towards the center of the top side 2 that is longer than the length of the light source mounting surface 4 beneath it.

Figure 12:
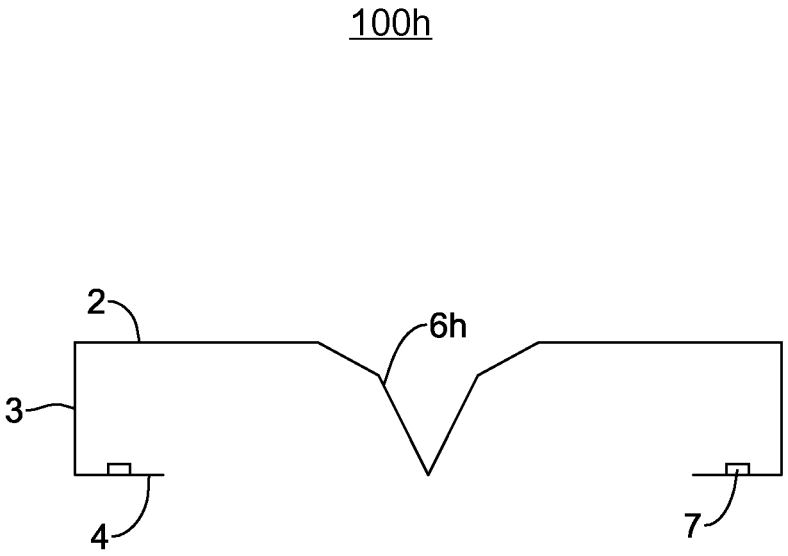

FIG. 12 shows a cross-section of a luminaire 100*h*, taken perpendicular to the opposing lateral sides 3. The top side 2 includes a protrusion 6*h* and two flat laterally extending portions, each one between the edge of the top side 2 and an edge of a lateral side 3 and the protrusion 6*h*. Each flat laterally extending portion of the top side 2 forms a right angle with its respective lateral side 3. The protrusion 6*h* is formed of four flat angled portions, the first two of which meet at a location below the center of the top side 2 and form an acute angle when measured from the outside of the luminaire 100*h*. The remaining two flat angled portions connect the first two flat angled portions to the flat laterally extending portions of the top side 2, each forming an obtuse angle between itself and the one of the first two flat angled portions when measured from the inside of the luminaire 100*h* and forming an obtuse angle between itself and the flat laterally extending portion to which it is adjacent when measured from the inside of the luminaire 100*h*.

Figure 13:
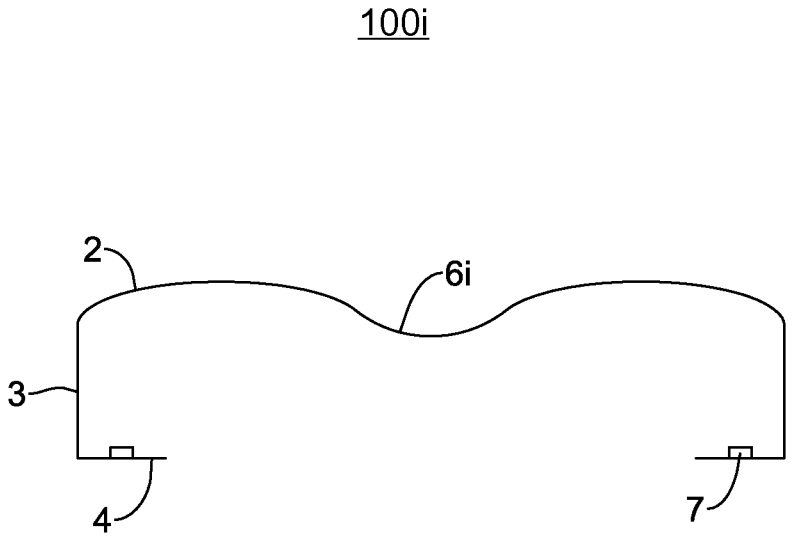

FIG. 13 shows a cross-section of a luminaire 100*i*, taken perpendicular to the opposing lateral sides 3. The luminaire 100*i* is similar to the luminaire 100*f* shown in FIG. 10, in that the top side 2 includes two portions, one on each side of a downward protrusion 6*i*, that are each formed of a curved portion that has an arc length that is less than that of a half circle, and forms an obtuse angle with both the lateral side 3 and the downward protrusion 6*i* when measured from the inside of the luminaire 100*f*. The downward protrusion 6*i*, in contrast to the downward protrusion 6*f* of the luminaire 100*f* shown in FIG. 10, is formed of a curved portion that has an arc length greater than the arc lengths of the two portions of the top side 2 but less than the arc length of a half circle. The downward protrusion 6*i*, at its lowest point, does not extend below the top of a lateral side 3.

Figure 14:
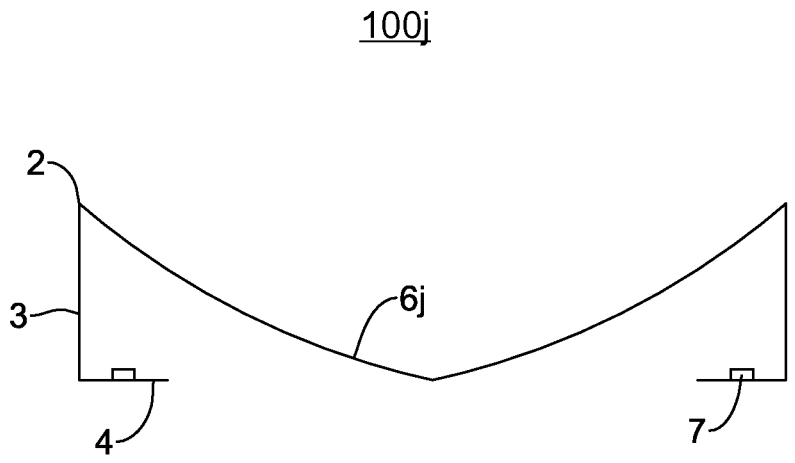

FIG. 14 shows a cross-section of a luminaire 100*j*, taken perpendicular to the opposing lateral sides 3. In the luminaire 100*j*, the top side 2 forms an acute angle with each lateral side 3 when measured from the inside of the luminaire 100*j*. A protrusion 6*j* of the top side 2 is formed from two arcs that each start where the top side 2 meets a respective lateral side 3 and meet in a location that is centered between the opposing lateral sides 3, where the two arcs form an angle less than 180° when measured from the outside of the luminaire 100*j*. The protrusion 6*j* does not extend past the bottom edge of the opposing lateral sides 3. The angle of each arc is located above the top side 2 of the luminaire 100*j*, such that each arc curves downward towards the location that is centered between the opposing lateral sides 3.

FIG. 15 shows a cross-section of a luminaire 100*k*, taken perpendicular to the opposing lateral sides 3. The luminaire 100*k* is similar to the luminaire 100*j* shown in FIG. 14, in that the luminaire 100*k* includes a top side having a protrusion 6*k* formed, in part, by two arcs that start where the top side 2 meets a respective lateral side 3 and extend towards a location that is centered between the opposing lateral sides 3. The two arcs that partially forming the protrusion 6*k*, however, each curve upward, such that the angle of each arc would be located below the luminaire 100*k*. The two arcs are connected in the location that is centered between the opposing lateral sides 3 by a small curve, instead of meeting at a point.

FIG. 16 is a cross-section of a luminaire 200, where the top side 2 is flat and includes no protrusion of any kind. In such embodiments, the intensity of the light emitted by the luminaire 200 typically appears a bit too low in the center of the flat top side 2. Of course, there may be applications and situations where this effect is desirable. This effect may be mitigating by making the flat top side 2 sufficiently narrow such that upward-propagating light reflected off the lateral sides 3 strikes the top side 2 near the center, resulting in a suitably uniform intensity pattern.

Figure 17:
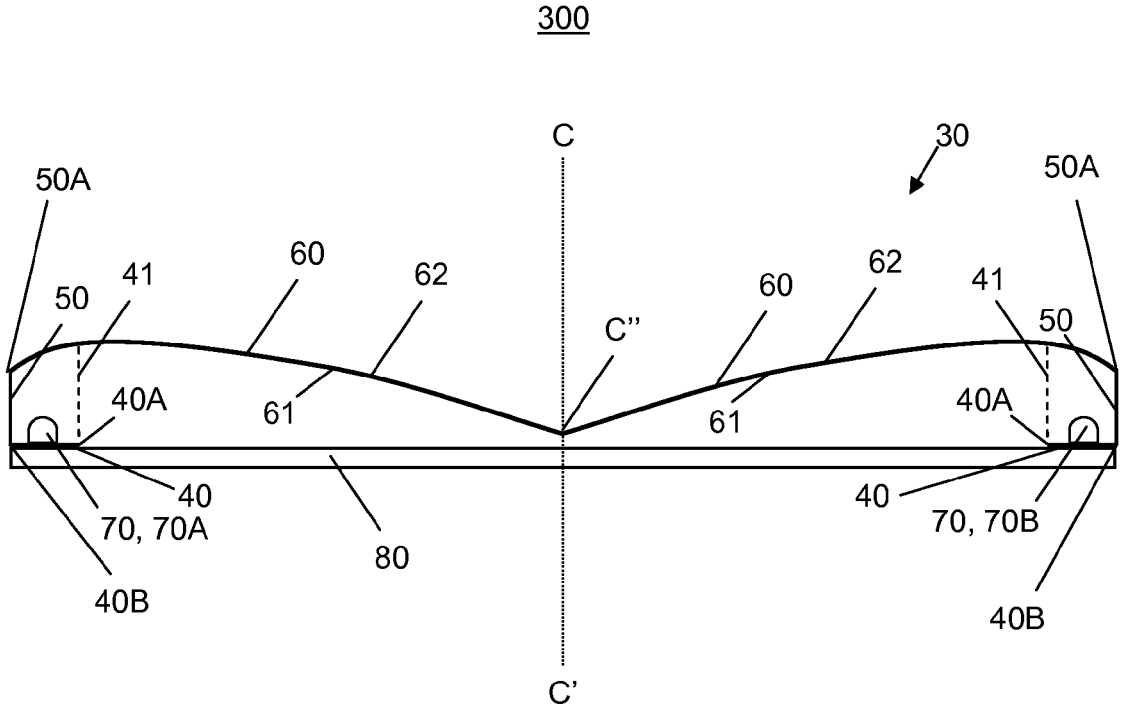
FIG. 17 is a cross-sectional schematic of a shaped downward-facing luminaire according to embodiments disclosed herein.

FIG. 17 is a cross-section of a shaped luminaire 300. The luminaire 300 includes a luminaire housing 30 and a set of solid state light sources 70. The luminaire housing 30 includes a pair of light source mounting surfaces 40, a pair of glossy reflective lateral sides 50, and a pair of arcs 60. In some embodiments, the pair of light source mounting surfaces 40, the pair of glossy reflective lateral sides 50, and the pair of arcs 60 are integrally formed. The pair of light source mounting surfaces 40 each extend laterally outward from an inner edge 40A to an outer edge 40B. In some embodiments, the pair of light source mounting surfaces 40 are each configured to receive a diffuser 80. In some embodiments, the diffuser 80 is connected to the luminaire at the pair of light source mounting surfaces 40. In some embodiments, the set of solid state light sources 70 is disposed on the pair of light source mounting surfaces 40, such that light emitted therefrom is diffused by the diffuser 80 upon exiting the luminaire housing 30 and thus the luminaire 300.

The pair of glossy reflective lateral sides 50 each extends generally upward from the outer edge 40B of a corresponding one of pair of the light source mounting surfaces 40 to a top edge 50A. The pair of glossy reflective lateral sides 50 are perpendicular, or in some embodiments substantially perpendicular, to the respective pair of light source mounting surfaces 40. In some embodiments, the pair of glossy reflective lateral sides 50 are made from a glossy reflective material, such as a Furukawa material. In some embodiments, the pair of glossy reflective lateral sides 50 are coated with a glossy reflective material, such as but not limited to a glossy white paint, a high reflectivity glossy paint, and so on. In some embodiments, the set of solid state light sources 70 is divided into a first subset 70A and a second subset 70B. In such embodiments, the first subset 70A is disposed on one of the pair of light source mounting surfaces 40 in proximity to its corresponding one of the pair of glossy reflective lateral sides 50, and the second subset 70B is disposed on the other of the pair of light source mounting surfaces 40 in proximity to its corresponding one of the pair of glossy reflective lateral sides 50.

The pair of arcs 60 each extend from the top edge 50A of a corresponding one of the pair of glossy reflective lateral sides 50 inward. Thus, the pair of arcs 60 meet at a point C" that is centered between the pair of glossy reflective lateral sides 50, and thus lies along a vertical axis C-C' that splits the luminaire 300. An angle of each arc 60 is located below the luminaire housing 30. Each of the pair of arcs 60 is glossy reflective. Thus, similar to the pair of glossy reflective lateral sides 50, in some embodiments, the pair of arcs 60 are made from a glossy reflective material, such as a Furukawa material, and in some embodiments, the pair of arcs 60 are coated with a glossy reflective material, such as but not limited to a glossy white paint, a high reflectivity glossy paint, and so on. The set of solid state light sources 40 are configured to emit light towards the pair of glossy reflective lateral sides 50 and the pair of arcs 60, such that a portion of the emitted light is specularly reflected and shaped by the angle of one of the pair of arcs 60, and a portion of the emitted light is diffusely reflected, prior to exiting the luminaire 300.

The combination of the curve of the pair of arcs 60 and the glossy reflective material of the pair of arcs 60 and the glossy reflective lateral sides 50 combine to generate a pleasing light emission from the luminaire 300. Thus, the curve of the pair of arcs 60 and the glossy reflective material used in the luminaire 300 are correlated such that a change in the curve of one or both of the pair of arcs 60 requires a corresponding change in the glossy reflective material as well. Thus, for example, in some embodiments, each of the pair of arcs 60 is a partial parabolic curve, as shown in FIG. 17, resulting in a relatively narrow profile for the luminaire 300. In other embodiments, where the curve of the pair of arcs 60 is wider, that is, the angle of each arc is greater, a less glossy reflective material should be used to coat the pair of glossy reflective lateral sides 50 and the pair of arcs 60, such as but not limited to a semi-gloss paint, a satin paint, or an eggshell paint, or these components should be made from less glossy materials. In some embodiments, each of the pair of arcs 60 is formed by a series of curves placed end-to-end.

Figure 18:
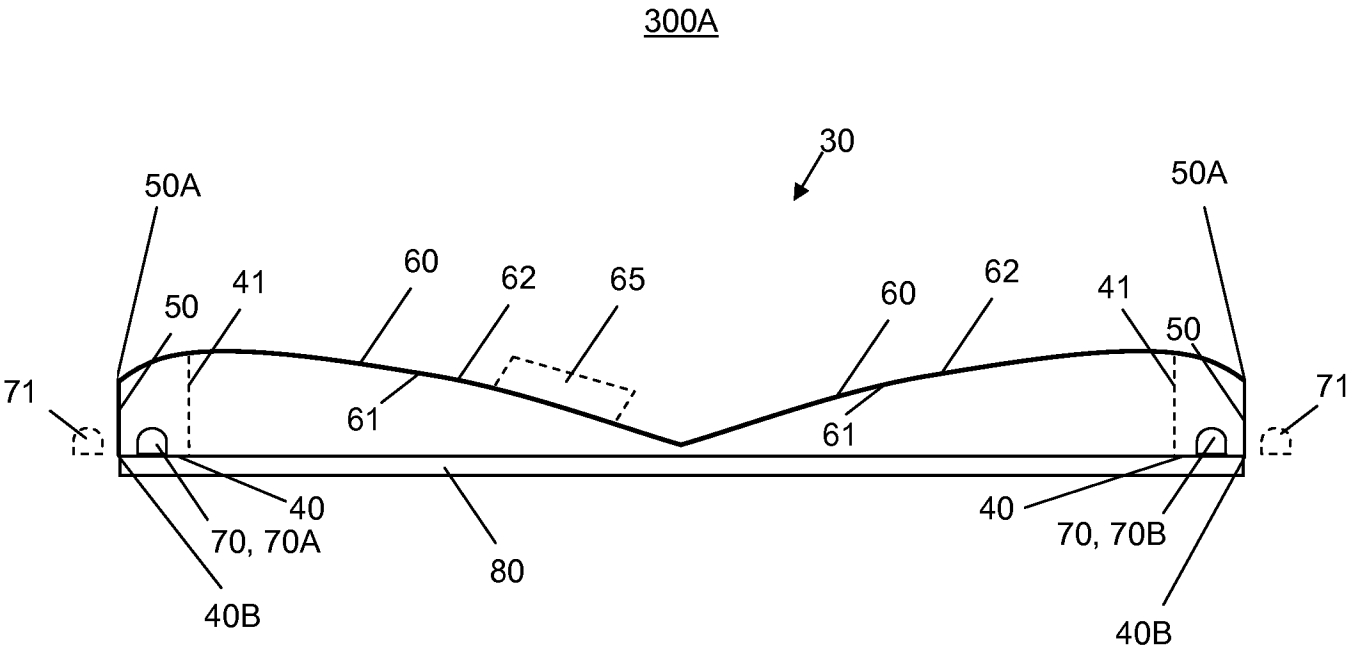
FIG. 18 is a cross-sectional schematic of a shaped downward-facing luminaire according to embodiments disclosed herein.

FIG. 18 is a cross-section of a luminaire 300A similar to the luminaire 300 of FIG. 17. In the luminaire 300A of FIG. 18, however, the pair of light source mounting surfaces 40 are a single, integrally formed surface made of a diffusive material. In other words, in the luminaire 300A of FIG. 18, the diffuser 80 is the light source mounting surface 40 (and vice versa). In some such embodiments, an optional pair of windows 41 encloses the set of solid state light sources 70. Each window 41 in the pair of windows 41 extends from a corresponding one of the pair of light source mounting surfaces 40 (which are a single, integral surface 40 here, but in some embodiments remain a separate pair of surfaces) towards a corresponding one of the pair of arcs 60. In some embodiments, as shown in FIG. 18, the first subset of solid state light sources 40A is behind one of the pair of windows 41, and the second subset of solid state light sources 40B is behind the other of the pair of windows 41.

In the luminaires 300 and 300A, each of the arcs in the pair of arcs 60 has an internal surface 61 that faces one of the pair of light source mounting surfaces 40 and an opposing external surface 62. In some embodiments, as shown in FIG. 18, one of the pair of arcs 60 is configured to receive a power supply (not shown) on its external surface 62 via a power supply enclosure 65.

The pair of arcs 60 of the luminaire 300A are each partial parabolic curves, with a focus of a parabola of which each partial parabolic curve is a part being located exterior to one of the pair of glossy reflective lateral sides 50, and shown in FIG. 18A as an image 71 of one of the solid state light sources in the set of solid state light sources 70.

Figure 19:
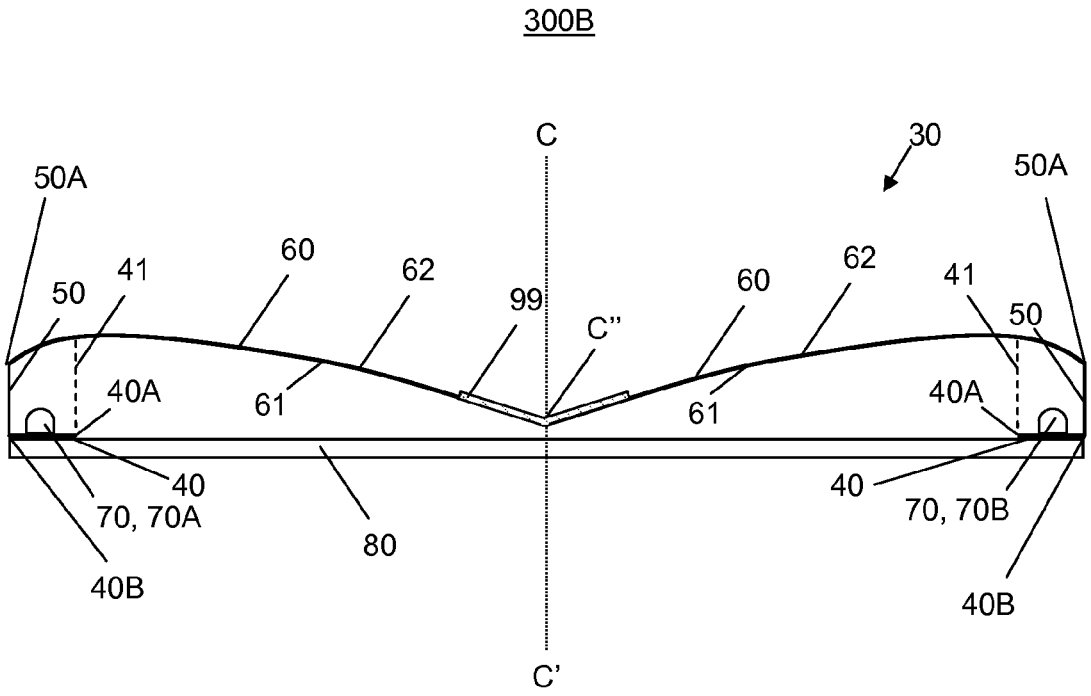
FIG. 19 is a cross-sectional schematic of a shaped downward-facing luminaire including an angled reflector according to embodiments disclosed herein.

FIG. 19 is a cross-section of a luminaire 300B including an angled reflector 99. More specifically, the angled reflector 99 is centered between the pair of glossy reflective lateral sides 50. Thus, the angled reflector 99 is located along the vertical axis C-C', and a center of the angled reflector 99 is at the point C" on that vertical axis. The pair of arcs 60 thus each extend from the top edge 50A of a corresponding one of the pair of glossy reflective lateral sides 50 inward, such that the pair of arcs 60 meet at the angled reflector 99, as shown in FIG. 19. In such embodiments, each of the pair of arcs 60 is glossy reflective, and the angled reflector 99 is also glossy reflective.

Figure 20:
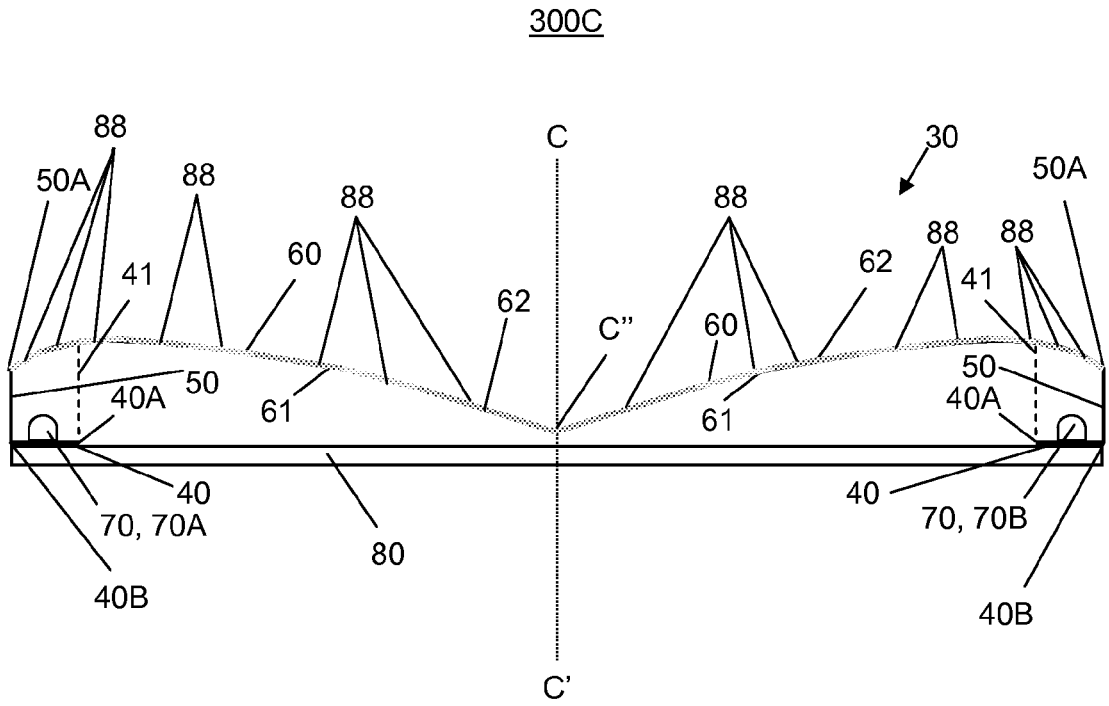
FIG. 20 is a cross-sectional schematic of a shaped downward-facing luminaire according to embodiments disclosed herein.

FIG. 20 is a cross-section of a luminaire 300C that is similar to the luminaire 300 of FIG. 17, but instead of having a pair of arcs 60 (shown in FIG. 17), rather has a set of connected straight line segments 88 that approximate the series of curves, and thus the pair of arcs 60 of FIG. 17.

Though the luminaires 300, 300A, 300B, and 300C of FIGS. 17-20, respectively, are shown such that they are symmetrical about the central vertical axis C-C', embodiments are not so limited. Thus, in some embodiments, one of the pair of arcs 60 is shaped as shown in FIG. 17, and the other of the pair of arcs 60 is shaped as shown in FIG. 20. In other words, combinations of different arc shapes and configurations (such as including the central angled reflector shown in FIG. 19) are possible and a luminaire according to embodiments disclosed herein need not be symmetrical along the central vertical axis C-C'.

Though embodiments have been described throughout as having a shape suitable for a troffer-style luminaire, other luminaire styles, such as but not limited to a suspended pendant and other indirect-lighting luminaires, are within the scope of the invention. Further, in some embodiments, the light source mounting surface may extend along all or most of a perimeter of the luminaire, rather than just along opposing sides. Further, in some embodiments, the top side of the luminaire housing may have more of an X-shaped pattern than the left-right-symmetric patterns shown above. In general, one of ordinary skill in the art will be able to simulate the performance of the more complicated top side shapes, and will be able to adjust the shape to optimize performance using known simulation software.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or an and/or the to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A luminaire housing, comprising:

a pair of light source mounting surfaces, each extending laterally outward from an inner edge to an outer edge;

a pair of glossy reflective lateral sides, each extending generally upward from the outer edge of a corresponding one of pair of the light source mounting surfaces to a top edge;

a pair of arcs, each arc extending from a top edge of a corresponding one of the pair of glossy reflective lateral sides inward, such that the pair of arcs meet at a point that is centered between the pair of glossy reflective lateral sides, wherein an angle of each arc is located below the luminaire housing, wherein each of the pair of arcs is glossy reflective; wherein the pair of light source mounting surfaces are each configured to receive a diffuser; and wherein a set of solid state light sources is disposed on the pair of light source mounting surfaces, such that light emitted therefrom is diffused by the diffuser upon exiting the luminaire housing.

2. The luminaire housing of claim 1, wherein a first subset of the set of solid state light sources is disposed on one of the pair of light source mounting surfaces in proximity to its corresponding one of the pair of glossy reflective lateral sides, and wherein a second subset of the set of solid state light sources is disposed on the other of the pair of light source mounting surfaces in proximity to its corresponding one of the pair of glossy reflective lateral sides.

3. The luminaire housing of claim 1, wherein the set of solid state light sources is enclosed behind a pair of windows, each window in the pair of windows extending from a corresponding one of the pair of light source mounting surfaces towards a corresponding one of the pair of arcs.

4. The luminaire housing of claim 3, wherein each of the pair of glossy reflective lateral sides and each of the pair of arcs is coated with one of a semi-gloss paint, a satin paint, or an eggshell paint.

5. The luminaire housing of claim 1, wherein each of the pair of glossy reflective lateral sides and each of the pair of arcs is coated with high reflectivity glossy paint.

6. The luminaire housing of claim 1, wherein each of the pair of arcs is a partial parabolic curve.

7. The luminaire housing of claim 6, wherein a focus of a parabola defined at least in part by one of the partial parabolic curves is located exterior to one of the pair of glossy reflective lateral sides.

8. The luminaire housing of claim 1, wherein each of the pair of arcs is formed by a series of curves.

9. The luminaire housing of claim 8, wherein each of the series of curves is formed by a corresponding set of connected straight line segments, such that each corresponding set of connected straight line segments approximates one of the pair of arcs.

10. The luminaire housing of claim 1, wherein each of the arcs in the pair of arcs has an internal surface that faces one of the pair of light source mounting surfaces and an opposing external surface, and wherein one of the pair of arcs is configured to receive a power supply on its external surface.

11. The luminaire housing of claim 1, wherein the pair of light source mounting surfaces, the pair of glossy reflective lateral surfaces, and the pair of arcs are integrally formed.

12. A luminaire, comprising:

a luminaire housing, comprising:

a pair of light source mounting surfaces, each extending laterally outward from an inner edge to an outer edge;

a pair of glossy reflective lateral sides, each extending generally upward from the outer edge of a corresponding one of pair of the light source mounting surfaces to a top edge; and a pair of arcs, each arc extending from a top edge of a corresponding one of the pair of glossy reflective lateral sides inward, such that the pair of arcs meet at a point that is centered between the pair of glossy reflective lateral sides, wherein an angle of each arc is located below the luminaire housing, wherein each of the pair of arcs is glossy reflective; and a set of solid state light sources disposed on the pair of light source mounting surfaces and configured to emit light towards the pair of glossy reflective lateral sides and the pair of arcs, wherein a portion of the emitted light is specularly reflected and shaped by the angle of one of the pair of arcs, and wherein a portion of the emitted light is diffusely reflected, prior to exiting the luminaire.

13. The luminaire of claim 12, further comprising a diffuser, wherein the diffuser is connected to the luminaire at the pair of light source mounting surfaces.

14. The luminaire of claim 12, wherein the pair of light source mounting surfaces are a single, integrally formed surface made of a diffusive material.

15. The luminaire of claim 14, further comprising a pair of windows behind which are enclosed the set of solid state light sources, each window in the pair of windows extending from the single, integrally formed surface towards a corresponding one of the pair of arcs.

16. The luminaire of claim 12, wherein each of the arcs in the pair of arcs has an internal surface that faces one of the pair of light source mounting surfaces and an opposing external surface, and wherein one of the pair of arcs comprises a power supply enclosure, configured to receive a power supply, on its external surface.

17. The luminaire of claim 12, wherein the pair of arcs comprises:

a pair of arcs, each arc extending from a top edge of a corresponding one of the pair of glossy reflective lateral sides inward, such that the pair of arcs meet at an angled reflector that is centered between the pair of glossy reflective lateral sides, wherein an angle of each arc is located below the luminaire housing, wherein each of the pair of arcs is glossy reflective, and wherein the angled reflector is glossy reflective.

* * * * *